US011946664B2

(12) United States Patent
Patil et al.

(10) Patent No.: US 11,946,664 B2
(45) Date of Patent: Apr. 2, 2024

(54) HIGH VELOCITY WIND-DRIVEN RAIN LOUVER

(71) Applicant: Air Distribution Technologies IP, LLC, Milwaukee, WI (US)

(72) Inventors: Vikas Ashok Patil, Jaysingpur (IN); Akash Rajesh Agrawal, Mumbai (IN); Arunkumar Jagatheesan, Coimbatore (IN); Joseph S. Rockhold, Bates City, MO (US); Parmeshwar Ganeshrao Patil, Pune (IN); Melissa M. Massar, Lee's Summit, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 567 days.

(21) Appl. No.: 17/112,733

(22) Filed: Dec. 4, 2020

(65) Prior Publication Data

US 2021/0172646 A1 Jun. 10, 2021

Related U.S. Application Data

(60) Provisional application No. 62/944,954, filed on Dec. 6, 2019.

(51) Int. Cl.
*F24F 13/08* (2006.01)
*E04C 1/39* (2006.01)
(Continued)

(52) U.S. Cl.
CPC ..... *F24F 13/082* (2013.01); *E04C 1/392* (2013.01); *E04C 2/523* (2013.01); *F24F 2110/32* (2018.01); *F24F 2221/52* (2013.01)

(58) Field of Classification Search
CPC ..... E04C 1/392; E04C 2/523; F24F 13/08; F24F 13/082; F24F 2110/32; F24F 2221/52
(Continued)

(56) References Cited

U.S. PATENT DOCUMENTS 3,358,580 A * 12/1967 Freese ..... F24F 13/08 55/440
3,771,430 A * 11/1973 Lane ..... F24F 13/08 55/440
(Continued)

FOREIGN PATENT DOCUMENTS

CN 103291199 A * 9/2013

OTHER PUBLICATIONS

Architectural Louver Catalog, Ruskin, Apr. 11, 2018, p. 1-64, 3900 Dr. Greaves Rd. Kansas City, MO 64030, https://www.ruskin.com/doc/id/6935.

*Primary Examiner* — Edelmira Bosques
*Assistant Examiner* — Frances F. Hamilton
(74) *Attorney, Agent, or Firm* — Fletcher Yoder, P.C.

(57) ABSTRACT

A louver blade for a louver assembly includes a first section, a second section extending from the first section and including a crest of the louver blade, an extension extending from the second section to form a recess between the extension and the second section, and a protrusion extending from the second section toward the extension and configured to facilitate retention of the particles within the recess. The extension is configured guide particles into the recess in an installed configuration of the louver blade with the louver assembly.

20 Claims, 10 Drawing Sheets

(51) Int. Cl.
*E04C 2/52* (2006.01)
*F24F 13/14* (2006.01)
*F24F 110/32* (2018.01)

(58) Field of Classification Search
USPC ..... 454/279
See application file for complete search history.

(56) References Cited

U.S. PATENT DOCUMENTS 3,849,095 A * 11/1974 Regehr ..... B01D 45/08 55/440
3,870,488 A * 3/1975 Arndt ..... B01D 45/08 55/440
3,899,427 A * 8/1975 Connelly ..... B01D 21/0075 55/440
3,953,183 A * 4/1976 Regehr ..... B01D 45/08 55/440
4,175,938 A * 11/1979 Regehr ..... B01D 45/16 55/440
4,430,101 A * 2/1984 Sixsmith ..... B01D 45/06 55/440
4,581,051 A * 4/1986 Regehr ..... B01D 45/08 55/440
4,802,901 A * 2/1989 Wurz ..... B01D 45/06 55/440
4,958,555 A * 9/1990 Lentz ..... F24F 13/08 52/473
5,268,011 A * 12/1993 Wurz ..... B01D 45/08 55/440
5,297,373 A * 3/1994 Olsen ..... E06B 7/082 52/473
5,542,224 A * 8/1996 Olsen ..... F24F 11/74 52/473
5,839,244 A * 11/1998 Johnson ..... F24F 13/08 454/224
8,444,732 B2 * 5/2013 Bratton ..... B01D 45/08 55/443
2010/0099349 A1 * 4/2010 Gohring ..... F24F 13/18 49/92.1
2015/0135661 A1 * 5/2015 MacDonald ..... F24F 13/082 55/440
2018/0149384 A1 * 5/2018 Rockhold ..... F24F 13/082

* cited by examiner

HIGH VELOCITY WIND-DRIVEN RAIN LOUVER

CROSS REFERENCE TO RELATED APPLICATIONS

This application claims priority from and the benefit of U.S. Provisional Application Ser. No. 62/944,954, entitled "HIGH VELOCITY WIND-DRIVEN RAIN LOUVER," filed Dec. 6, 2019, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of an air flow delivered to and/or ventilated from a space. For example, the HVAC system may place the air flow in a heat exchange relationship with a refrigerant of a vapor compression circuit. The air flow may be directed through the HVAC system via a louver assembly. The louver assembly may include blades that are implemented to block certain elements, such as debris and precipitation, from flowing through the louver assembly. It is recognized that an improved louver assembly design is desirable to increase blockage of elements while enabling desired air flow through the louver assembly.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a louver blade for a louver assembly includes a first section, a second section extending from the first section and including a crest of the louver blade, an extension extending from the second section to form a recess between the extension and the second section, and a protrusion extending from the second section toward the extension and configured to facilitate retention of the particles within the recess. The extension is configured guide particles into the recess in an installed configuration of the louver blade with the louver assembly.

In one embodiment, a louver assembly for a heating, ventilation, and air conditioning (HVAC) system includes a louver blade. The louver blade has a first portion, a second portion extending from the first portion and forming a crest with the first portion, a first extension extending from the second portion on a first side of the louver blade to form a first recess between the second portion and the first extension, and a second extension extending from the second portion on a second side of the louver blade, opposite the first side, to form a second recess between the second portion and the second extension. The first extension and the second extension overlap with one another along an axis crosswise to a direction of air flow through the louver assembly. The louver assembly also includes a jamb frame coupled to the louver blade. The jamb frame includes a first channel and a second channel, the first channel is aligned with the first recess relative to the direction of air flow through the louver assembly, and the second channel is aligned with the second recess relative to the direction of air flow through the louver assembly.

In one embodiment, a louver blade for a louver assembly includes an upstream section comprising an incline portion, a midstream section having a decline portion extending from the incline portion to form a crest of the louver blade with the incline portion on a first side of the louver blade, and a downstream section extending from the midstream section. The louver assembly also includes an extension of the midstream section, the extension extending in an upstream direction to form a recess between the extension and the midstream section on the first side of the louver blade, and a protrusion of the midstream section, the protrusion extending toward the recess and is configured to retain liquid particles captured within the recess.

DRAWINGS

Various aspects of this disclosure may be better understood upon reading the following detailed description and upon reference to the drawings in which.

DETAILED DESCRIPTION

Figure 1:
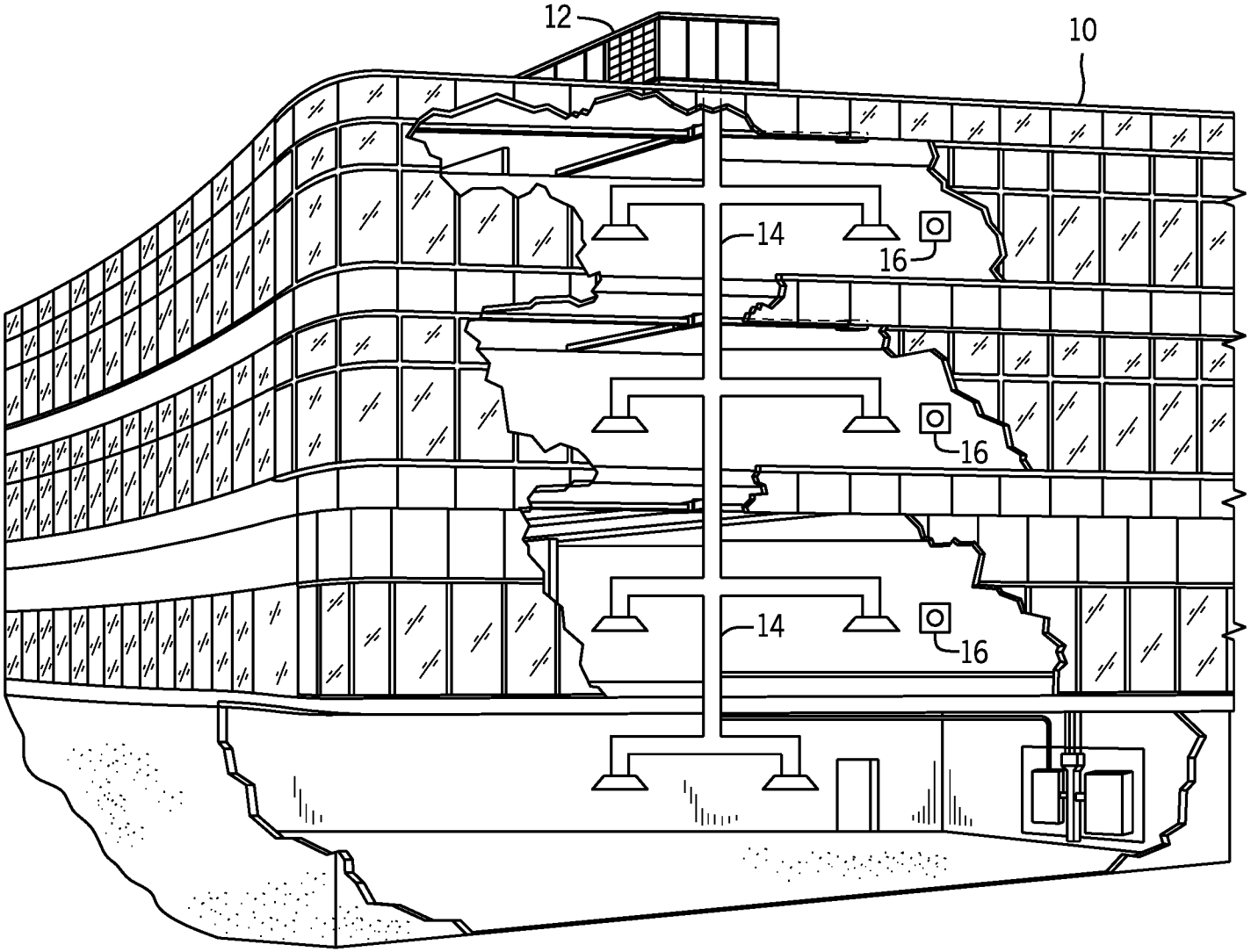
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a louver assembly for a heating, ventilation, and/or air conditioning (HVAC) system. The louver assembly may enable air to move into and/or out of the HVAC system or another enclosed space. For instance, the louver assembly may be disposed at an inlet of the HVAC system to enable control of an air flow from an ambient environment into the HVAC system, where the HVAC system may condition the air flow by adding and/or removing heat from the air flow. The louver assembly may additionally or alternatively be disposed at an outlet of the HVAC system to enable control of an air flow directed out of the HVAC system, such as to condition a space serviced by the HVAC system and/or to discharge an exhaust air flow. In further embodiments, the louver assembly may be configured to control an air flow within the HVAC system, such as between different components or portions of the HVAC system.

The louver assembly may include a frame (e.g., defined by frame segments) and blades secured to the frame. The frame may be coupled to another component of the HVAC system, such as to an air handler, ductwork, a support structure, and/or a heat exchanger, to enable control of air flow through the HVAC system. The blades may be disposed in the frame and may be arranged to block solid and/or liquid particles, including precipitation, dirt, and/or other debris, from passing through the louver assembly and into the HVAC system or another enclosed space. Indeed, it may be desirable to block solid and/or liquid particles from entering the HVAC system or enclosed space. For instance, the louver assembly may be subject to various standards and/or certifications indicative of an ability of the louver assembly to block solid and/or liquid elements from passing through the louver assembly. As an example, the louver assembly may be subject to criteria of the Air Movement and Control Association International, Inc. (AMCA) 550 standard for wind-driven rain resistance, in which the performance of the louver assembly during simulated rainfall at various wind speeds (e.g., 35 miles per hour, 70 miles per hour, 90 miles per hour, 110 miles per hour) is evaluated. The performance of the louver assembly may be assessed based on an amount or rate of water (e.g., 22 centimeters or 8.8 inches per hour) that passes through the louver assembly during simulated conditions. Certain blades of existing louver assemblies may not adequately block solid and/or liquid particles from passing through the louver assemblies. For example, the solid and/or liquid particles may pass through openings of the louver assembly formed between the blades. In other existing louver assemblies, blades may not enable sufficient air flow through the louver assemblies. For instance, the geometry of the blades may impart an elevated pressure drop that blocks air from flowing through the louver assemblies at a desirable flow rate. In either case, performance of such louver assemblies is undesirable.

Thus, it is presently recognized that a louver assembly with blades designed to adequately block solid and/or liquid particles from flowing through the louver assembly while enabling air to flow through the louver assembly at a desirable flow rate may improve performance of the louver assembly and of an HVAC system incorporating the louver assembly. Accordingly, embodiments of the present disclosure are directed to a louver assembly having louver blades that include extensions configured to function as barriers that block solid and/or liquid particles from flowing across the louver blades. Further, each louver blade may include recesses that retain solid and/or liquid particles and that direct the solid and/or liquid particles toward jamb frames of the louver assembly. The jamb frames may then direct the solid and/or liquid particles out of the louver assembly and away from the HVAC system or enclosed space. However, openings of the louver assembly formed between adjacent louver blades may be configured to enable sufficient air flow through the louver assembly, for example, to enable the HVAC system to operate desirably.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 in the illustrated embodiment is an air cooled device that implements a refrigeration or vapor compression cycle to provide conditioned air to the building 10. Specifically, the HVAC unit 12 may include one or more heat exchangers across which an air flow is passed to condition the air flow before the air flow is supplied to the building 10. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building 10 with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

As discussed above, the present disclosure is directed to a louver assembly that includes a frame or a frame assembly and louver blades having a geometry that enables desired amounts of air flow through the louver assembly while also blocking solid and/or liquid particles from flowing through the louver assembly. For example, the louver blades may include extensions that form recesses configured to receive, capture, or retain solid and/or liquid particles. The louver blades may also include features, such as protrusions, that retain the solid and/or liquid particles within the recesses. The frame or frame assembly may include a jamb frame coupled to the louver blades. The jamb frame may have channels that align with the recesses of the louver blades, and the channels may receive the solid and/or liquid particles captured or retained by the louver blades via the recesses. The channels may then discharge the solid and/or liquid particles out of the louver assembly. Further, the louver blades may be arranged to form openings between adjacent louver blades that enable air to flow through the louver assembly at a desirable flow rate. In this manner, the louver blades may enable improved control of air flow through the louver assembly.

Figure 2:
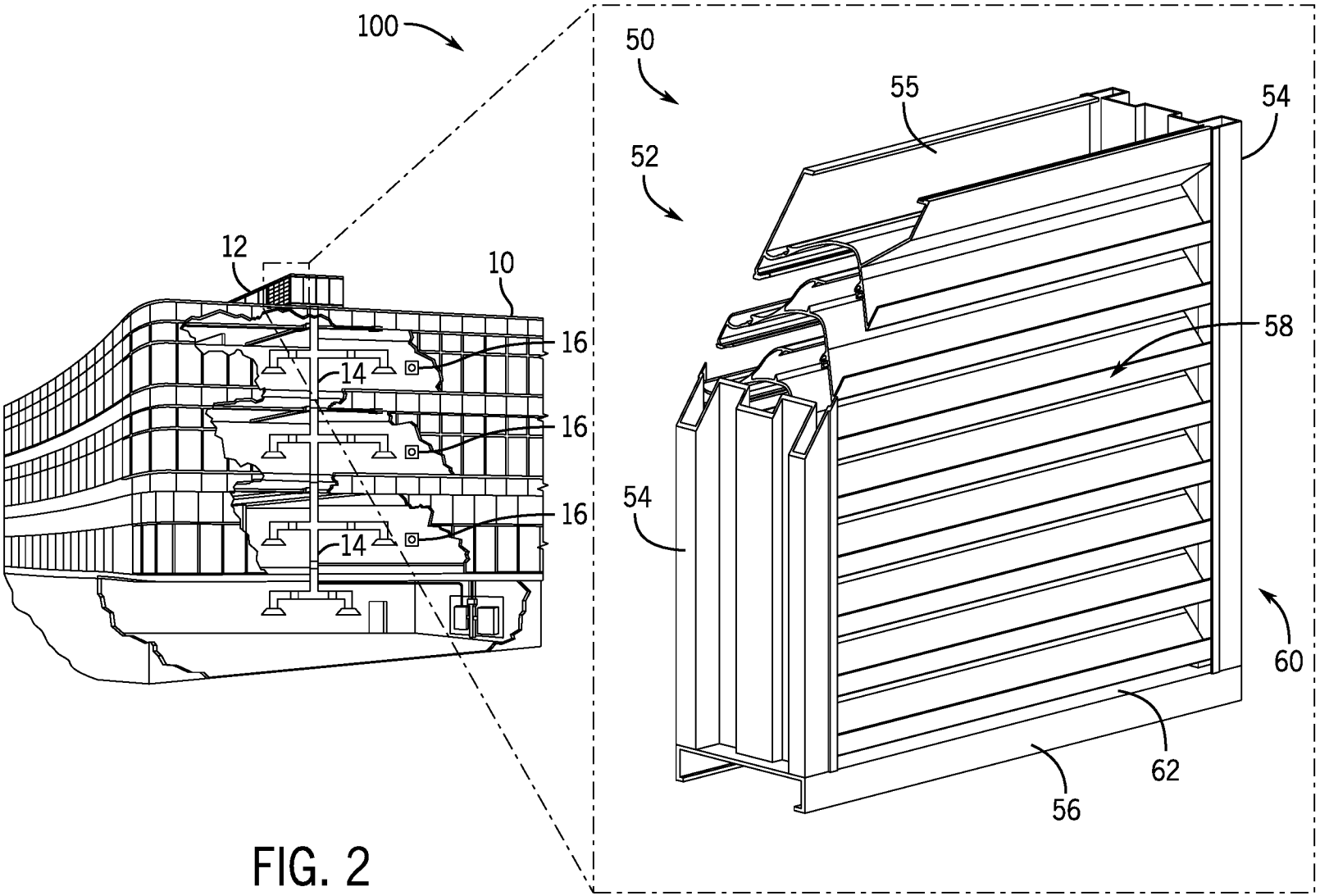
FIG. 2 is a perspective cutaway view of an embodiment of a louver assembly that may be incorporated in an HVAC system, in accordance with an aspect of the present disclosure.

With this in mind, FIG. 2 is a perspective view of an embodiment of a louver or a louver assembly 50 that may be incorporated in an HVAC system. For example, the louver assembly 50 may be positioned to control air flow between an ambient environment and an enclosed space, such as an interior of the HVAC unit 12. The air flow may be drawn into the HVAC unit 12 (e.g., for cooling refrigerant, for use as a supply air flow directed to a space conditioned by the HVAC unit 12) and/or may be discharged from the HVAC unit 12 (e.g., after use in conditioning the space conditioned by the HVAC unit 12). The louver assembly 50 may include a frame assembly 52 (e.g., a frame) defining an air flow path through the louver assembly 50 (e.g., from an upstream location to a downstream location). It should be noted that "upstream," "midstream," and "downstream" may be utilized herein with reference to a direction of air flow through the louver assembly 50. In some embodiments, the frame assembly 52 may include multiple frame members that are coupled one another to define a perimeter of the air flow path or the louver assembly 50. As an example, the frame assembly 52 may include jamb or lateral frames or frame members 54 defining a portion of the perimeter of the air flow path. Each of the jamb frames 54 may be configured to couple to a head or top frame or frame member 55 and to a sill or base frame or frame member 56. Each of the head frame 55 and the sill frame 56 may define additional portions of the perimeter of the air flow path. The jamb frame 54, the head frame 55, and the sill frame member 56 are coupled to one another to form a rectangular geometry in the illustrated frame assembly 52. However, in additional or alternative embodiments, the frame assembly 52 may have any other suitable geometry, such as a triangular shape, a trapezoidal shape, a diamond shape, a circular shape, and so forth, and/or may include any suitable number of frames defining the geometry (e.g., a perimeter) of the frame assembly 52. In any case, the frame assembly 52 may form an opening 60 through which air may flow.

The louver assembly 50 may further include blades or louver blades 58 that are coupled to the frame assembly 52, such as to the jamb frames 54. Each of the louver blades 58 may span across the opening 60. Indeed, the louver blades 58 may be configured to block solid and/or liquid particles (e.g., solid and/or liquid particles carried by the air flow) from passing through the louver assembly 50 via the opening 60. For example, the louver blades 58 may block precipitation, dust, dirt, and/or debris from flowing through the opening 60. In certain embodiments, the position of the louver blades 58 may remain fixed relative to the frame assembly 52. That is, louver blades 58 may not move relative to the frame assembly 52 in an assembled configuration of the louver assembly 50. As such, the louver blades 58 may be shaped to block the flow of the solid and/or liquid particles through the opening 60. For instance, as further discussed herein, the louver blades 58 may be configured to trap solid and/or liquid particles and to guide the particles toward the jamb frames 54, and the jamb frames 54 may be configured to guide the solid and/or liquid particles to flow out of the louver assembly 50 (e.g., into the ambient environment and away from an interior of the HVAC unit 12) in an installed configuration of the louver assembly 50. For example, the jamb frames 54 may direct the solid and/or liquid particles onto a surface 62 of the sill frame 56 via a gravitational force, and the surface 62 may direct the solid and/or liquid particles away from the louver assembly 50 via an opening formed between the sill frame 56 and an adjacent louver blade 58. Additionally, the louver blades 58 may enable air flow through the louver assembly 50 via the opening 60, which may enable efficient operation of the HVAC unit 12. Indeed, openings formed between the louver blades 58 may permit a desired amount or quality of air flow through the louver assembly 50.

Figure 3:
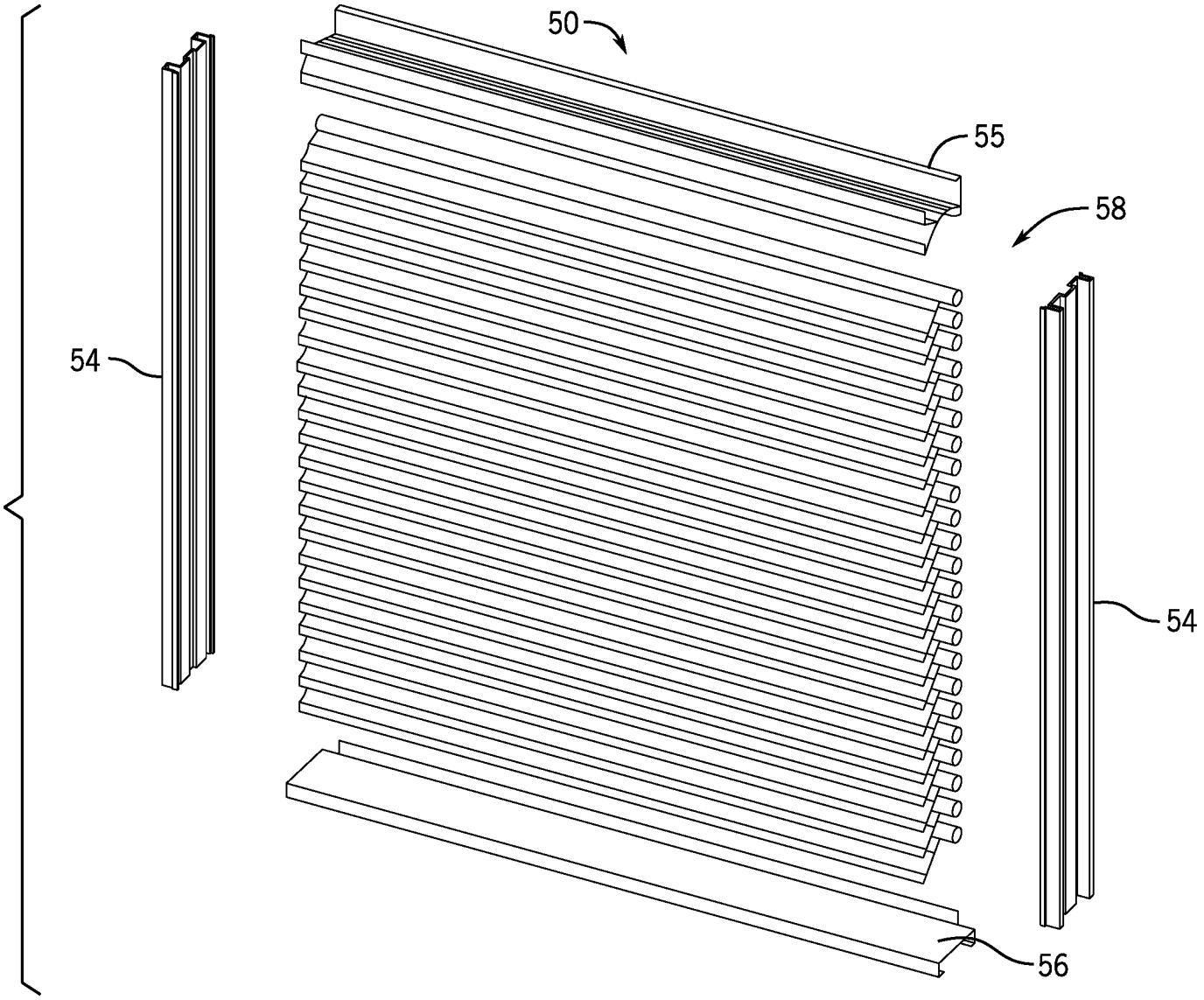
FIG. 3 is an exploded perspective view of an embodiment of a louver assembly that may be incorporated in an HVAC system, in accordance with an aspect of the present disclosure.

FIG. 3 is an exploded perspective view of an embodiment of the louver assembly 50. In the illustrated embodiment, the jamb frames 54, the head frame 55, and the sill frame 56, and are separate components configured to couple to one another. For example, fasteners may be used to couple the frames 54, 56, 55 to one another to form the frame assembly 52. Further, each of the louver blades 58 may be configured to couple to the jamb frames 54. As an example, opposite ends of each louver blade 58 may be coupled to a respective jamb frame 54 in the assembled configuration of the louver assembly 50. In the manner described below, solid and/or liquid particles trapped by the louver blades 58 may be guided toward the ends of the louver blades 58 and to the jamb frames 54. The jamb frames 54 may then guide the solid and/or liquid particles onto the sill frame 56 and away from the louver assembly 50.

Figure 4:
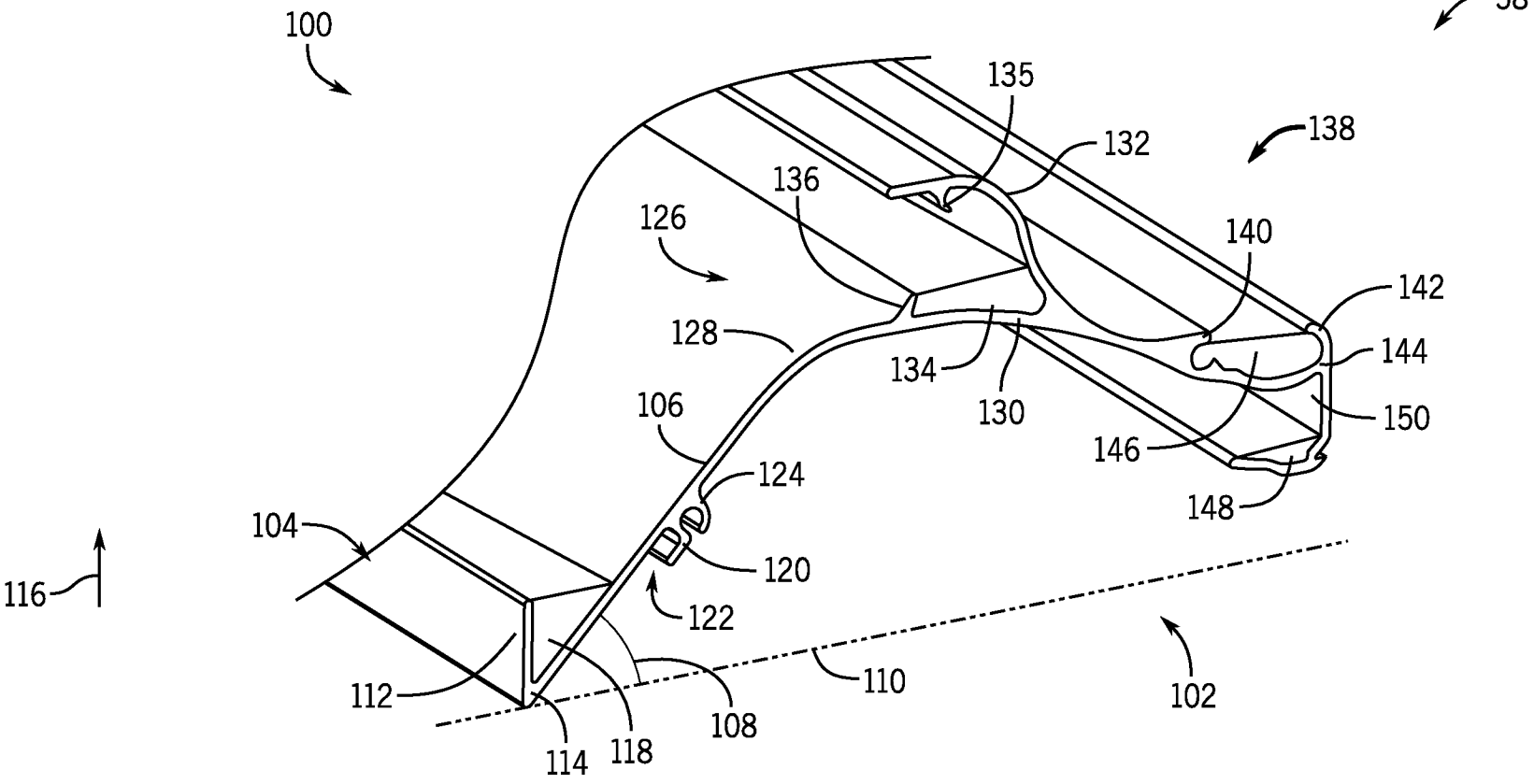
FIG. 4 is a partial perspective view of an embodiment of a louver blade that may be incorporated in a louver assembly, in accordance with an aspect of the present disclosure.

FIG. 4 is a partial perspective view of an embodiment of one of the louver blades 58 of the louver assembly 50. The louver blade 58 may include a first side, profile, or surface 100 (e.g., a top of the louver blade 58) and a second side, profile, or surface 102 (e.g., a bottom or underside of the louver blade 58) opposite the first side 100. Each of the first side 100 and the second side 102 may have or define geometries and features that block solid and/or liquid particles from passing through the louver assembly 50. For example, a first section 104 (e.g., an upstream or front section) of the louver blade 58 may include an incline portion 106 that is oriented at an angle 108 (e.g., an angle between 20 degrees and 60 degrees) relative to a horizontal axis 110 extending through the louver assembly 50. The incline portion 106 may create a barrier (e.g., of the first side 100) configured to block a flow of solid and/or liquid particles and deflect the solid and/or liquid particles away from the louver assembly 50, such as away from a space downstream of the louver assembly 50 (e.g., the interior of an HVAC system). In some embodiments, the first section 104 may also include a first extension 112 extending from a first distal or upstream end 114 (e.g., along a vertical axis 116) of the incline portion 106 to block solid and/or liquid particles flowing toward the incline portion 106. The first extension 112 may also form a first recess 118 in the first side 100 between the first extension 112 and the incline portion 106. Thus, solid and/or liquid particles may impinge impact the incline portion 106, and the incline portion 106 may direct the solid and/or liquid particles to flow into the first recess 118 via a gravitational force. The first recess 118 may then guide the solid and/or liquid particles to flow toward the jamb frames 54 and out of the louver assembly 50 (e.g., instead of onto an adjacent louver blade 58).

The louver blade 58 may also include a first protrusion or finger 120 extending from the incline portion 106 on the second side 102 to form a hook profile 122 that is shaped to block additional solid and/or liquid particles from flowing across the louver blade 58 and through the louver assembly 50. By way of example, the hook profile 122 may capture mist that may be formed from precipitation flowing between the louver blade 58 and an adjacent louver blade 58. The mist may accumulate to form water droplets on the hook profile 122, and the hook profile 122 may direct the water droplets out of the louver assembly 50, such as toward the first recess 118 of an adjacent louver blade 58, via the gravitational force. In the illustrated embodiment, the first protrusion 120 is adjacent to (e.g., cooperatively forms) a first feature 124 (e.g., a screw boss, a protrusion, a retention passage) configured to receive a fastener to couple or mount the louver blade 58 to one of the jamb frames 54. In additional or alternative embodiments, the first protrusion 120 and the first feature 124 may be separate from one another. As an example, the first feature 124 may extend from the incline portion 106 on the first side 100 of the louver blade 58, and the first protrusion 120 may extend from the incline portion 106 on the second side 102 of the louver blade 58.

The louver blade 58 may include a second section 126 (e.g., a middle or midstream section) that includes additional features configured to block the flow of solid and/or liquid particles through the louver assembly 50. In the illustrated embodiment, the incline portion 106 may form a crest 128 (e.g., a peak) with a decline portion 130 of the louver blade 58, and the first section 104 may transition to the second section 126 at the crest 128. That is, the first section 104 may include the incline portion 106, and the second section 126 may include a portion of the decline portion 130. The second section 126 may include a second extension 132 extending from the decline portion 130 to form a second recess 134 between the decline portion 130 and the second extension 132. Indeed, the second extension 132 may extend from the decline portion 130 at an angle between the horizontal axis 110 and the vertical axis 116. The second recess 134 may capture additional solid and/or liquid particles, such as solid and/or liquid particles deflected off the incline portion 106, and the second extension 132 may guide the solid and/or liquid particles into the second recess 134. Indeed, the second extension 132 may also extend (e.g., linearly extend) toward the first section 104 and over the crest 128 to form the second recess 134. In other words, the second extension 132 may extend in an upstream direction relative to a direction of air flow across the louver blade 58

The second section 126 may include various features to retain solid and/or liquid particles within the second recess 134. For example, a second protrusion or finger 135 may extend from the second extension 132 at an angle and may be sized to guide solid and/or liquid particles (e.g., precipitation) to flow into the second recess 134 and block solid and/or liquid particles (e.g., mist) from flowing out of the second recess 134. A third protrusion or finger 136 may extend from the crest 128 or the decline portion 130 at an angle and distance, such that the third protrusion 136 also guides solid and/or liquid particles to flow into the second recess 134 and blocks solid and/or liquid particles from flowing out of the second recess 134. The second protrusion 135 and the third protrusion 136 may cooperatively retain the solid and/or liquid particles within the second recess 134, and the second recess 134 may then direct the solid and/or liquid particles to the jamb frames 54 for discharge from the louver assembly 50. That is, the second protrusion 135 and/or the third protrusion 136 may increase a retention capacity of the second recess 135.

The louver blade 58 may further include a third section 138 (e.g., a downstream or tail section) having the second extension 132 extending from the decline portion 130. The third section 138 may include a portion of the decline portion 130 and a second feature 140 (e.g., a screw boss, a protrusion, a retention passage) formed in the decline portion 130 and configured to receive a fastener to couple the louver blade 58 to one of the jamb frames 54. A third extension 142 may extend from a second or downstream distal end 144 of the decline portion 130 on the first side 100. The second feature 140 and the third extension 142 may form a third recess 146 on the first side 100. The third recess 146 may be configured to capture solid and/or liquid particles, such as solid and/or liquid particles deflected off or directed by the second extension 132 and/or the decline portion 130. Furthermore, the third section 138 may include a fourth extension 148 extending from the second distal end 144 of the decline portion 130 and forming a fourth recess 150 on the second side 102. The fourth recess 150 may have a hook geometry configured to capture and retain solid and/or liquid particles flowing adjacent to the second side 102, such as along the underside of the louver blade 58. Each of the third recess 146 and the fourth recess 150 may direct the solid and/or liquid particles toward the jamb frames 54 and out of the louver assembly 50.

Figure 5:
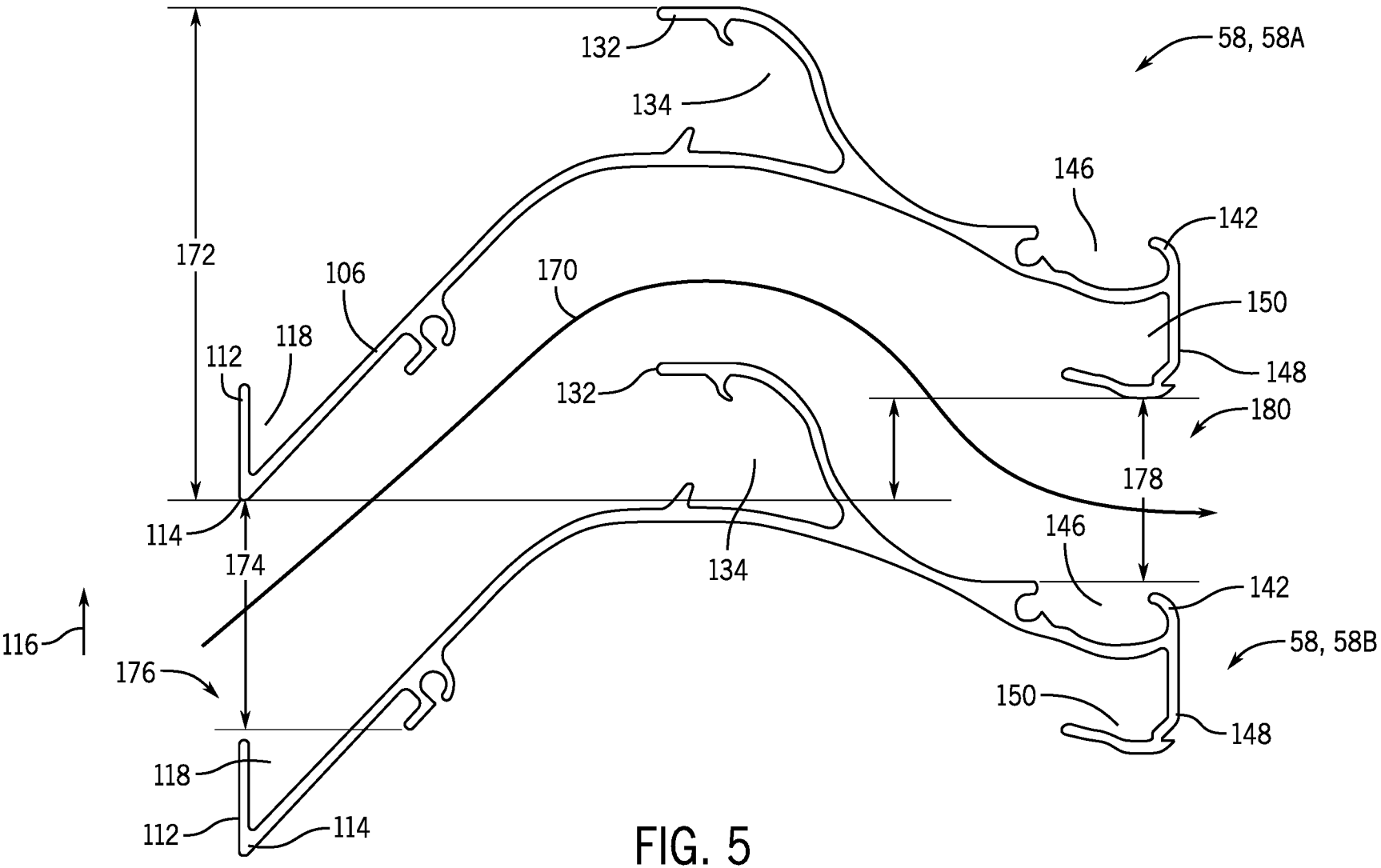
FIG. 5 is an axial view of an embodiment of louver blades that may be incorporated in a louver assembly, in accordance with an aspect of the present disclosure.

FIG. 5 is an axial view of an embodiment of adjacent louver blades 58 of the louver assembly 50. The illustrated louver blades 58 have substantially identical geometries. In additional or alternative embodiments, louver blades 58 may have different geometries. The adjacent louver blades 58 may form an air flow path 170 between the louver blades 58 and through the louver assembly 50. For example, air (e.g., supply air) may flow underneath a first louver blade 58A and above a second louver blade 58B. Further, the recesses 118, 134, 146, 150 of each louver blade 58 may capture solid and/or liquid particles flowing along the air flow path 170 to block the solid and/or liquid particles from passing through the louver assembly 50 (e.g., into an HVAC system or other space).

The louver blades 58 may be positioned relative to one another to block solid and/or liquid particles (e.g., a substantial amount of solid and/or liquid particles to which the louver assembly 50 is exposed) while enabling a desirable amount of air to flow through the louver assembly 50. For instance, each of the louver blades 58 may have a first height 172 extending from the first distal end 114 of the incline portion 106 along the vertical axis 116 to the second extension 132. The louver blades 58 may be positioned relative to one another such that a second height 174 of a first opening 176 (e.g., an inlet of the louver assembly 50) formed between the first distal end 114 of the first louver blade 58A and the first extension 112 (e.g., a top of the first extension 112) of the second louver blade 58B is between approximately 40 percent to 65 percent of the first height 172. Furthermore, a third height 178 of a second opening 180 (e.g., an outlet of the louver assembly 50) formed between the fourth extension 148 (e.g., a bottom or trough of the fourth extension 148) of the first louver blade 58A and the third extension 142 of the second louver blade 58B may be between approximately 25 percent and 50 percent of the first height 172. To this end, a third height 182 between the first distal end 114 and the fourth extension 148 of the same louver blade 58 (e.g., the first louver blade 58A in FIG. 5) may be between approximately 25 percent and 35 percent of the first height 172. The relative positioning of the louver blades 58 may provide desirable blocking of solid and/or liquid particles through the louver assembly 50 while limiting pressure drop and/or undesired restriction of air flow through the louver assembly 50. Indeed, the arrangement of the louver blades 58 having the features described herein may block solid and/or liquid particles from flowing through the louver assembly 50 without incorporation of additional components, such as actuatable dampers, grilles, screens, and the like, that may increase the cost, complexity, weight, and so forth, of the louver assembly 50.

Figure 6:
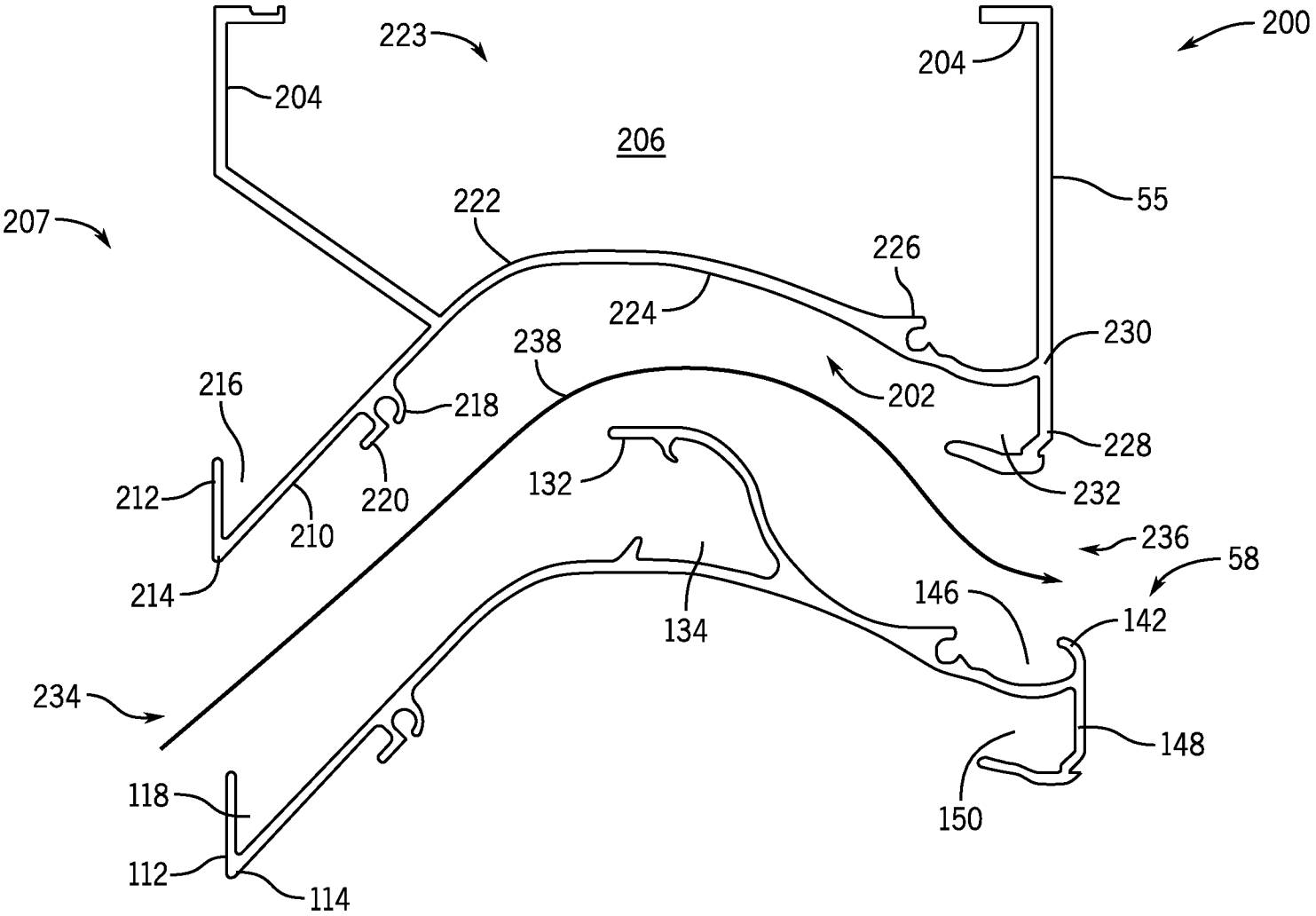
FIG. 6 is an axial view of an embodiment of a head frame and a louver blade that may be incorporated in a louver assembly, in accordance with an aspect of the present disclosure.

FIG. 6 is an axial view of an embodiment of the head frame the head frame 55 and an adjacent louver blade 58 of the louver assembly 50. The head frame 55 may include a first side or profile 200 (e.g., a top side or profile) and a second side or profile 202 (e.g., a bottom side or profile) opposite the first side 200. The first side 200 may include support segments 204 having hook portions that may be used for installation and/or assembly of the louver assembly 50. For instance, the support segments 204 may at least partially form a channel 206, and the support segments 204 may capture a support (e.g., an enclosure of the HVAC system, a structure of a building, etc.) and secure the support within the channel 206 in order to couple the louver assembly 50 to the support via the head frame 55.

The head frame 55 may have one or more features similar to or corresponding with the adjacent louver blade 58 (e.g., the second side 102 the louver blade 58 discussed above with reference to FIG. 4). For example, the head frame 55 includes a first section 207 (e.g., a front section) having an 210, a first extension 212 extending from a first or upstream distal end 214 of the incline portion 210 to form a first recess 216 configured to retain solid and/or liquid particles, a first feature 218 (e.g., a screw boss, a protrusion, a retention passage) extending from the incline portion 210 on the second side 202 of the head frame 55 and configured to receive a fastener for coupling the head frame 55 to one of the jamb frames 54, and a first protrusion 220 extending from the incline portion 210 adjacent to the first feature 218 on the second side 202 of the head frame 55. The incline portion 210 may form a crest 222 at a second section 223 (e.g., middle or midstream section) of the head frame 55. The second section 223 may include a decline portion 224 extending from the crest 222. A second feature 226 (a screw boss, a protrusion, a retention passage) is formed along the decline portion 224 on the first side 200 of the head frame 55 and is configured to receive a fastener to couple the head frame 55 to one of the jamb frames 54. Further still, the head frame 55 includes a third section 227 (e.g., downstream or tail section). The third section 227 may include a second extension 228 extending from a second or downstream distal end 230 of the decline portion 224 on the second side 202 of the head frame 55 to form a second recess 232 configured to retain solid and/or liquid particles. In the illustrated embodiment, one of the support segments 204 extends from the incline portion 210 and therefore may block solid and/or liquid particles and/or air from flowing between the incline portion 210 and the support segment 204, thereby blocking solid and/or liquid particles and/or air from flowing between the head frame 55 and the support to which the louver assembly 50 is coupled. Further, the other of the support segments 204 may extend from the second distal end 230, as shown.

The head frame 55 may be positioned relative to the adjacent louver blade 58 in a similar manner in which adjacent louver blades 58 are positioned relative to one another. That is, a first opening 234 (e.g., an inlet of the louver assembly 50) may be formed between the first distal end 214 of the head frame 55 and the first extension 112 (e.g., a top or distal end of the first extension 112) of the adjacent louver blade 58. As similarly discussed above, the first opening 234 may have a height that is between approximately 40 percent and 65 percent of the first height 172 of the louver blade 58. Furthermore, a second opening 236 (e.g., an outlet of the louver assembly 50) may be formed between the second extension 228 (e.g., a bottom or trough of the second extension 228) and the third extension 142 of the adjacent louver blade 58. The second opening 236 may have a height that is between approximately 25 percent and 50 percent of the first height 172 of the louver blade 58. Indeed, the head frame 55 and the adjacent louver blade 58 may form an air flow path 238 through which air may flow while also blocking solid and/or liquid particles from flowing through the louver assembly 50.

The louver blades 58 discussed herein may each be formed as a single integral piece. For instance, the louver blades 58 may be formed via welding, bending, molding, and the like. In additional or alternative embodiments, the louver blades 58 may be formed from separate pieces that are coupled to one another, such as via fasteners, an adhesive, an interference fit, or any combination thereof. Further, the louver blades 58 may be formed from a material that is suitable for resisting impact of particles. For example, the louver blades 58 may be formed from a metal, a ceramic, an alloy or composite material, a polymer, or any combination thereof, having a suitable strength and rigidity to withstand various environmental conditions and flow or impact forces of solid and/or liquid particles.

Figure 7:
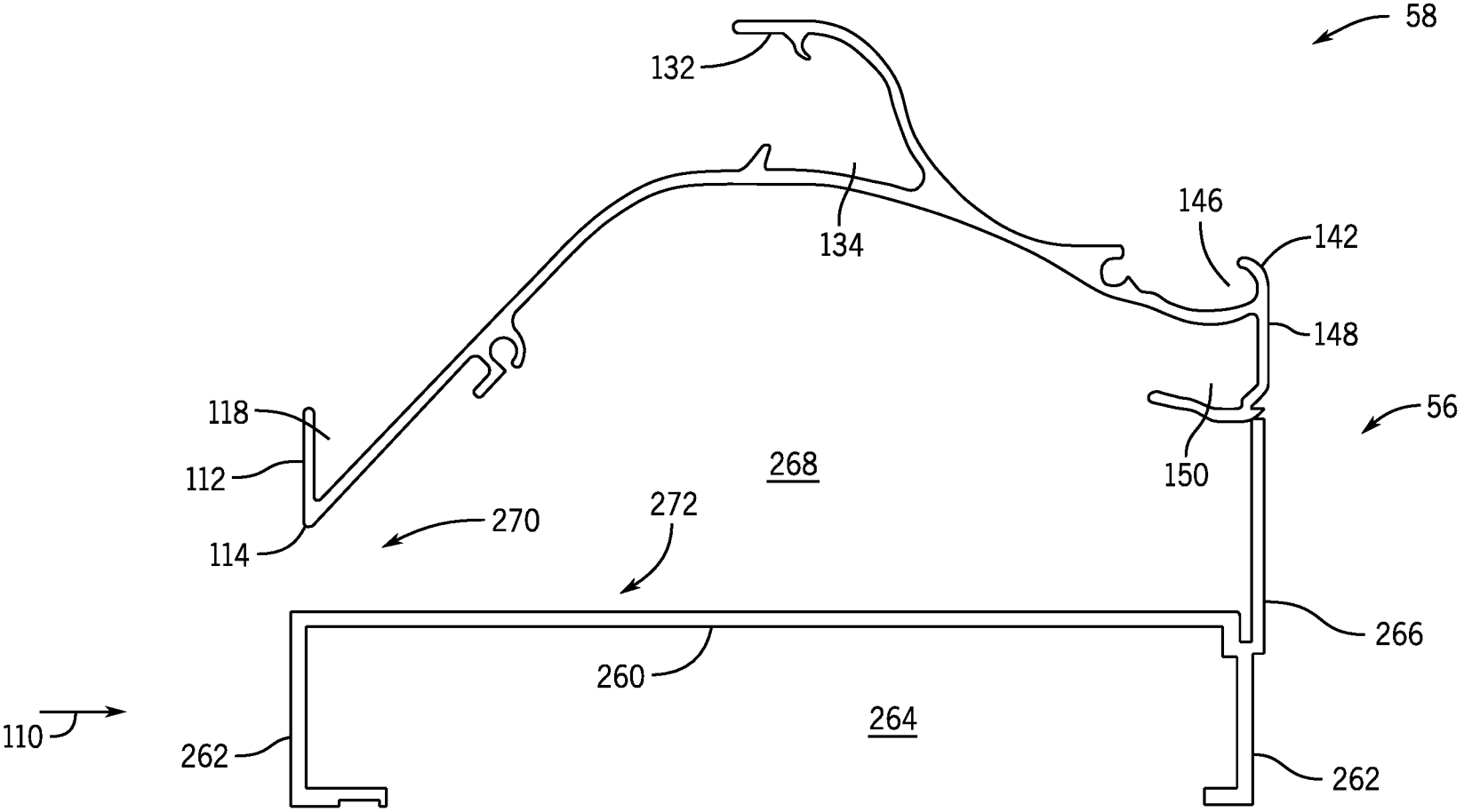
FIG. 7 is an axial view of an embodiment of a sill frame and a louver blade that may be incorporated in a louver assembly, in accordance with an aspect of the present disclosure.

FIG. 7 is an axial view of an embodiment of the sill frame 56 and an adjacent louver blade 58. The illustrated sill frame 56 includes a base 260 and support segments 262 extending from the base 260. The support segments 262 may each be hook-shaped to at least partially form a channel 264, and the support segments 262 may capture a support or other structure. In this way, the support may be secured within the channel 264 to couple the louver assembly 50 to the support via the sill frame 56. The sill frame 56 may also include a mounting segment 266 extending from the base 260. In an assembled configuration of the louver assembly 50, the sill frame 56 may abut against the fourth extension 148 of the adjacent louver blade 58, thereby blocking flow of air and solid and/or liquid particles through the louver assembly 50 between the adjacent louver blade 58 and the sill frame 56.

Furthermore, the above-described engagement between the sill frame 56 and the adjacent louver blade 58 may form a cavity 268 defined by the sill frame 56 and the adjacent louver blade 58. The cavity 268 may receive solid and/or liquid particles (e.g., precipitation), such as solid and/or liquid particles captured by the louver blades 58 and directed into the jamb frames 54. That is, solid and/or liquid particles within the jamb frames 54 may be discharged into the cavity 268. An opening 270 may be formed between the base 260 and the first distal end 114 of the adjacent louver blade 58 to enable the solid and/or liquid particles to flow out of the cavity 268. For instance, the solid and/or liquid particles received from the jamb frames 54 may accumulate on a surface 272 of the base 260 and may flow out of the opening 270 (e.g., into an ambient environment). In the illustrated embodiment, the base 260 is substantially level or parallel with the horizontal axis 110. However, in additional or alternative embodiments, the base 260 may be positioned at an angle relative to the horizontal axis 110, such as at an angle to direct the solid and/or liquid particles out of the cavity 268 through the opening 270 via gravitational force.

Figure 8:
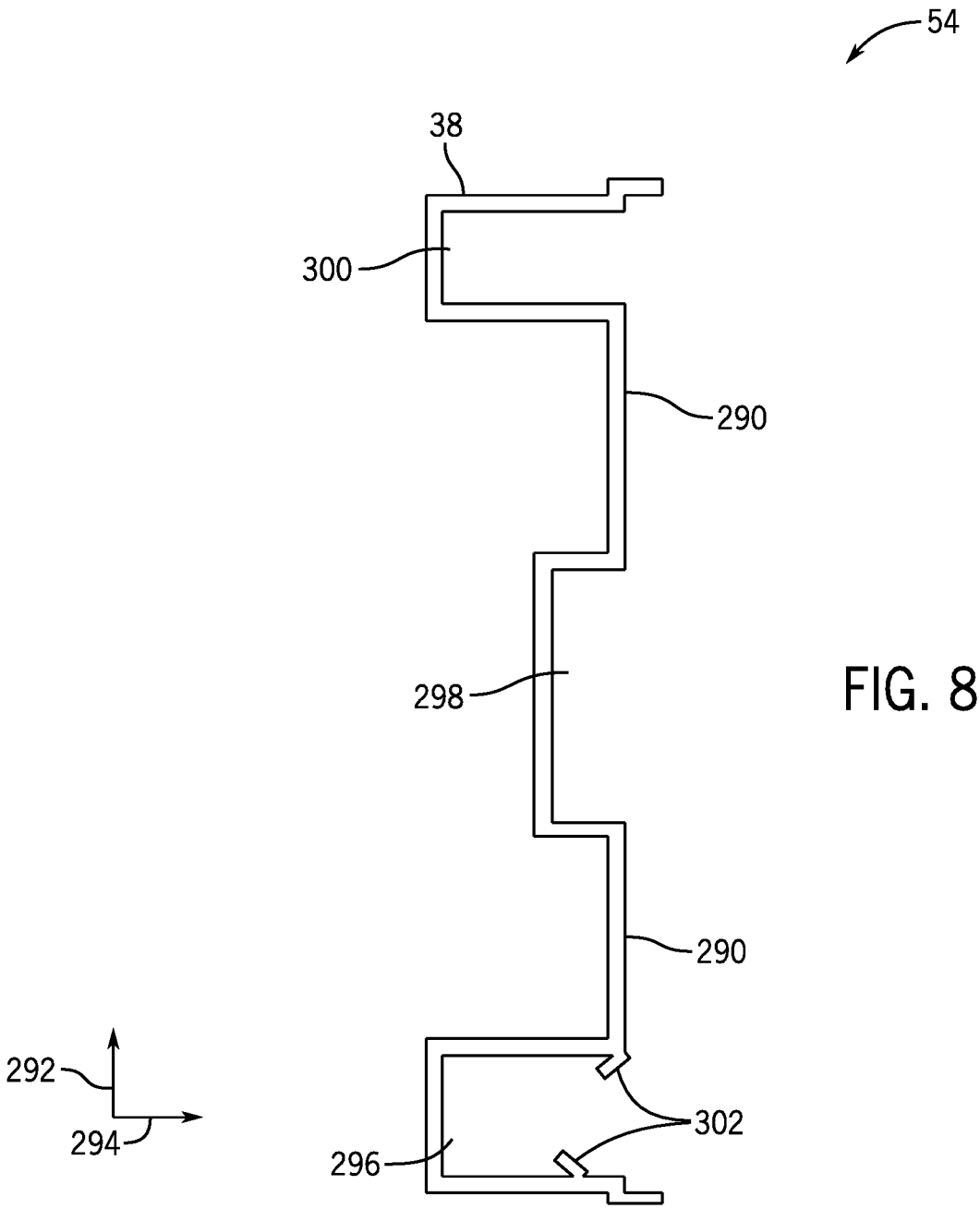
FIG. 8 is a top view of an embodiment of a jamb frame that may be incorporated in a louver assembly, in accordance with an aspect of the present disclosure.

FIG. 8 is a top view of an embodiment of the jamb frame 54. In some embodiments, each of the jamb frames 54 (e.g., the jamb frames 54 positioned at either lateral side of the louver assembly 50) may have a similar, such as a mirrored, geometry. In additional or alternative embodiments, the jamb frames 54 of the louver assembly 50 may have different geometries. The illustrated jamb frame 54 includes base segments 290 that extend along a first axis 292 (e.g., the horizontal axis 110, a flow direction through the louver assembly 50, etc.). Each of the base segments 290 may also be aligned with one another relative to a second axis 294 (e.g., the base segments 290 extend along a common axis that is generally parallel to the first axis 292) and may be configured to abut the sill frame 56, the head frame 55, and the louver blades 58 in an assembled configuration of the louver assembly 50.

Further, the jamb frame 54 may include a first channel 296, a second channel 298, and a third channel 300. In the assembled configuration of the louver assembly 50, the first channel 296 may be aligned with the respective first recesses 118 of the louver blades 58 relative to the first axis 292 or a direction of air flow through the louver assembly 50 (e.g., the first channel 296 and the first recesses 118 are positioned along a common axis extending generally parallel to the second axis 294) and may be configured to receive solid and/or liquid particles captured and directed thereto by the first recesses 118. In addition, the second channel 298 may be aligned with the respective second recesses 134 of the louver blades 58 relative to the first axis 292 or a direction of air flow through the louver assembly 50 (e.g., the second channel 298 and the second recesses 134 are positioned along a common axis extending generally parallel to the second axis 294) and may be configured to receive solid and/or liquid particles captured and directed thereto by the second recesses 134. Further, the third channel 300 may be aligned with the respective third recesses 146 and the fourth recesses 150 of the louver blades 58 relative to the first axis 292 or a direction of air flow through the louver assembly 50 (e.g., the third channel 300 and the third recesses 146 are positioned along a common axis extending generally parallel to the second axis 294) and may be configured to receive solid and/or liquid particles captured and directed thereto by each of the third recesses 146 and the fourth recesses 150. Each of the channels 296, 298, 300 may guide the solid and/or liquid particles received from the louver blades 58 toward the sill frame 56 for removal from the louver assembly 50 in the installed configuration. Although the illustrated channels 296, 298, 300 have rectangular geometries, additional or alternative embodiments of the channels 296, 298, 300 may have any suitable shape to receive and direct solid and/or liquid particles.

The illustrated jamb frame 54 also includes protrusions or fingers 302, which may extend into the first channel 296 at an angle (e.g., relative to the second axis 294). The protrusions 302 may be oriented to guide the solid and/or liquid particles into the first channel 296 while blocking the solid and/or liquid particles from traveling out of the first channel 296 in the installed configuration. Thus, the protrusions 302 may improve guidance of the solid and/or liquid particles into and through the first channel 296 to be directed out of the louver assembly 50. Additional or alternative embodiments of the jamb frame 54 may include protrusions 302 extending into any of the other channels 298, 300 to improve guidance of the solid and/or liquid particles into and through the other channels 298, 300.

Figure 9:
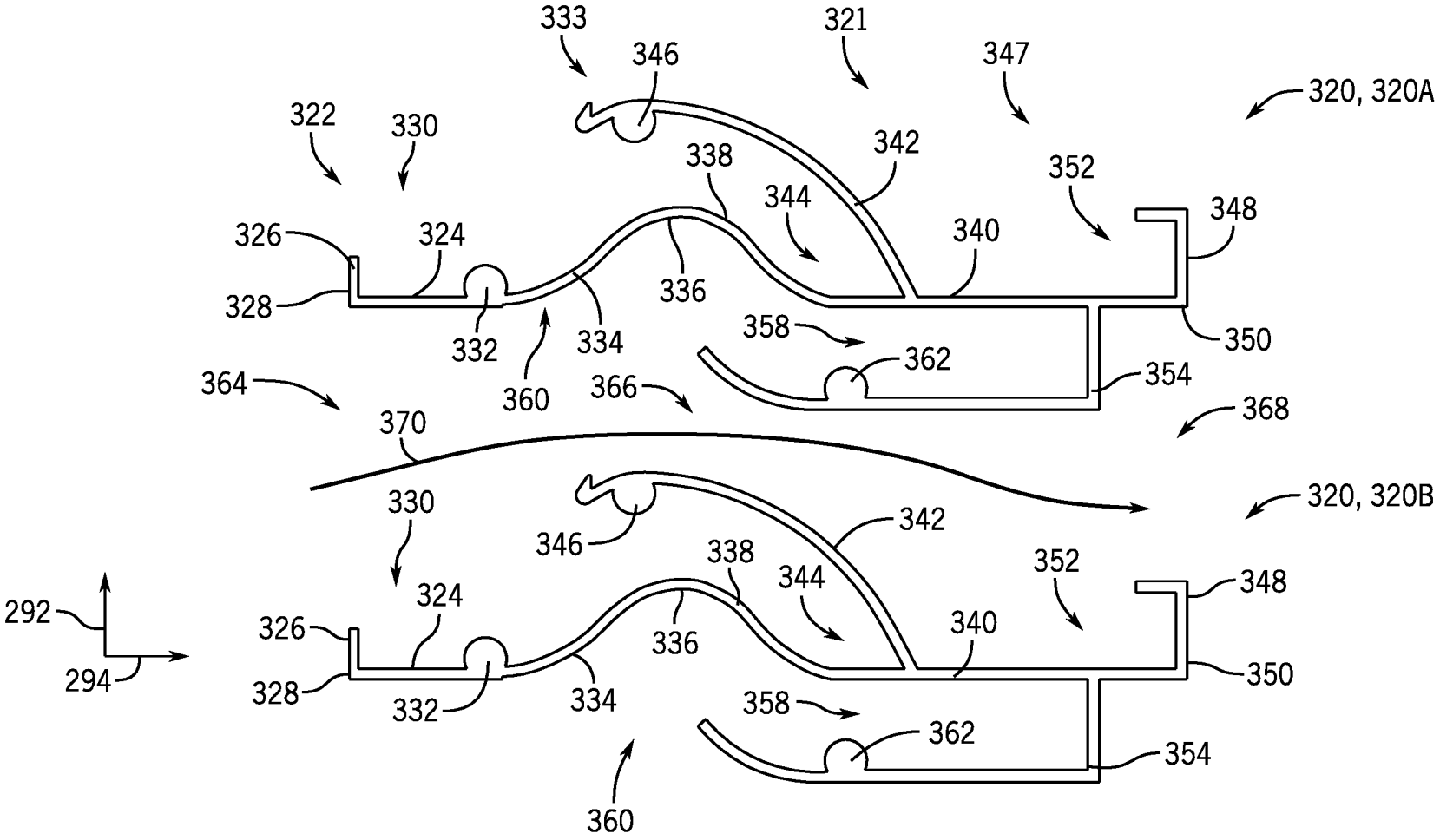
FIG. 9 is an axial view of an embodiment of louver blades that may be incorporated in a louver assembly, in accordance with an aspect of the present disclosure.

FIG. 9 is an axial view of an embodiment of louver blades 320 that may be incorporated in the louver assembly 50. Each of the louver blades 320 in the illustrated embodiment has a similar geometry. In additional or alternative embodiments, different louver blades 320 in the louver assembly 50 may have different geometries. As an example, each louver blade 320 may include a first section 322 (e.g., an upstream or front section) that may have a first segment 324 (e.g., linear, planar, and/or generally horizontal segment). Each louver blade 320 may also include a first side 321 (e.g., a profile on a top side of the louver blade 320) having a first extension 326 extending from a first or upstream distal end 328 of the first segment 324 (e.g., generally along the vertical axis 116). Thus, the first segment 324 and the first extension 326 may cooperatively form a first recess 330 between the first segment 324 and the first extension 326 on the first side 321 of the louver blade 320. As similarly described above, the first recess 330 is configured to retain solid and/or liquid particles captured by the louver assembly 50 and to direct the solid and/or liquid particles toward the jamb frames 54. Each of the illustrated louver blades 320 also includes a first feature 332 (e.g., a screw boss, a protrusion, a retention passage) extending from the first segment 324 on the first side 321. The first features 332 may receive respective fasteners to couple the louver blades 320 to one of the jamb frames 54.

Each of the louver blades 320 may also include a second section 333 (e.g., a middle or midstream section) that includes an incline portion 334 extending from the first feature 332 and/or the first segment 324. The incline portion 334 may shaped (e.g., angled, curved) to block flow of solid and/or liquid particles through the louver assembly 50 and/or to direct solid and/or liquid particles toward the first recess 330. The incline portion 334 may form a crest 336, and a decline portion 338 of the second section 333 may extend from the crest 336 and transition into a second segment 340 (e.g., linear, planar, and/or generally horizontal segment). In some embodiments, the decline portion 338 may extend to or beyond (e.g., below) a level of the first segment 324, such that the second segment 340 is level with or below the first segment 324 along the vertical axis 116.

A second extension 342 may extend from the second segment 340 to form a second recess 344 between the second extension 342 and the decline portion 338 on the first side 321 of the louver blade 320. In the illustrated embodiment, the second extension 342 has a curved geometry that may extend over the crest 336 relative to the vertical axis 116 and beyond the crest 336 along the horizontal axis 110 (e.g., in an upstream direction), thereby blocking or capturing solid and/or liquid particles that may deflect off the incline portion 334, the crest 336, and/or the decline portion 338. Further, the crest 336 may facilitate guidance of solid and/or liquid particles into, and retention of solid and/or liquid particles within, the second recess 344. The second recess 344 may direct the solid and/or liquid particles toward the jamb frames 54 in the installed configuration of the louver assembly 50. Each of the illustrated louver blades 320 further includes a second feature 346 (e.g., a screw boss, a protrusion, a retention passage) extending from the second extension 342, such as toward the second recess 344. The second features 346 may also receive respective fasteners to couple the louver blades 320 to one of the jamb frames 54. In addition, the second features 346 may also block solid and/or liquid particles (e.g., mist) from flowing out of the second recess 344, thereby facilitating the capture of the solid and/or liquid particles within the second recess 344 during use of the louver assembly 50 and increasing a retention capacity of the second recess 344.

Each of the louver blades 320 may further include a third section 347 (e.g., a downstream or tail section) having a third extension 348 extending from a second or downstream distal end 350 of the second segment 340 on the first side 321 of the louver blade 320 to form a third recess 352 between the second segment 340 and the third extension 348 on the first side 321. The third extension 348 may block or capture solid and/or liquid particles, such as solid and/or liquid particles directed over the second extension 342. Indeed, the third extension 348 may include a hook shape to increase a retention capacity of the third recess 352, and the third recess 352 may direct the solid and/or liquid particles toward the jamb frames 54. Moreover, each of the louver blades 320 may include a fourth extension 354 extending from the second segment 340 and forming a fourth recess 358 between the second segment 340 and the fourth extension 354 on a second side 360 of the louver blade 320 (e.g., a bottom side opposite the first side 321). The fourth extension 354 may include a hook shape to increase a retention capacity of the fourth recess 358. For instance, the fourth extension 354 may extend upstream and curve upwards (e.g., at a position vertically aligned with the crest 336) to block captured solid and/or liquid particles from flowing out of the fourth recess 358, thereby retaining the solid and/or liquid particles within the fourth recess 358. Indeed, the fourth extension 354 may extend to overlap (e.g., vertically overlap) with the decline portion 338 along the vertical axis 116 (e.g., an axis crosswise to a direction of air flow through the louver assembly 50) so as to capture solid and/or liquid particles within the fourth recess 358 that deflect off the incline portion 334, the crest 336, the decline portion 338, or any combination thereof, on the second side 360 of the louver blade 320. The fourth recess 358 may direct the solid and/or liquid particles to the jamb frames 54 for removal from the louver assembly 50 in the manner described above.

In the illustrated embodiment, each of the louver blades 320 includes a third feature 362 (e.g., a screw boss, a protrusion, a retention passage) extending from the fourth extension 354 (e.g., toward the second segment 340) and configured to receive a fastener configured to couple the louver blade 320 to one of the jamb frames 54. The third feature 362 may also extend toward or into the fourth recess 358 and may be configured to block solid and/or liquid particles from flowing out of the fourth recess 358, thereby further facilitating capture of the solid and/or liquid particles within the fourth recess 358.

It should be noted that any of the features 332, 346, 362 may be positioned along the louver blade 320 at different locations or orientations in additional or alternative embodiments of the louver blade 320. For instance, the first feature 332 may be disposed on the second side 360, the third feature 362 may extend from the fourth extension 354, and so forth. In further embodiments, the louver blade 320 may include a different number of features, such as two features or more than three features configured to enable coupling of the louver blade 320 to the jamb frames 54.

The illustrated adjacent louver blades 320 form a first opening 364 (e.g., an inlet of the louver assembly 50) between the first distal end 328 of a first louver blade 320A and the first extension 326 (e.g., a top of the first extension 326) of a second louver blade 320B. Further, the fourth extension 354 of the first louver blade 320A may overlap (e.g., vertically overlap) with the second extension 342 along the vertical axis 116 and may therefore extend over the second extension 342 of the second louver blade 320B to form a second opening 366 (e.g., a neck). The adjacent louver blades 320 may also form a third opening 368 (e.g., an outlet of the louver assembly 50) between the second distal end 350 of the first louver blade 320A and the third extension 348 (e.g., a top of the third extension 348) of the second louver blade 320B. In this manner, the louver blades 320 may enable air to flow through the louver assembly 50 along an air flow path 370 extending through the first opening 364, the second opening 366, and the third opening 368 while the features of the louver blades 320 described above enable capture, retention, and discharge of liquid and/or solid particles directed into the louver assembly 50.

The louver assembly 50 incorporating the louver blades 320 may also have a differently shaped head frame 55, jamb frame 54, and/or sill frame 56 than those described above. By way of example, the head frame 55 may include a second side 202 having features corresponding with those of the second side 360 of the louver blade 320 rather than those of the second side 102 of the louver blade 58 described with respect to FIG. 4. Additionally or alternatively, the jamb frame 54 may include channels that are positioned and/or shaped to align with the recesses 330, 344, 352, 358, thereby enabling the jamb frame 54 to receive solid and/or liquid particles captured and directed by the louver blades 58 and to direct the solid and/or liquid particles out of the louver assembly 50.

Figure 10:
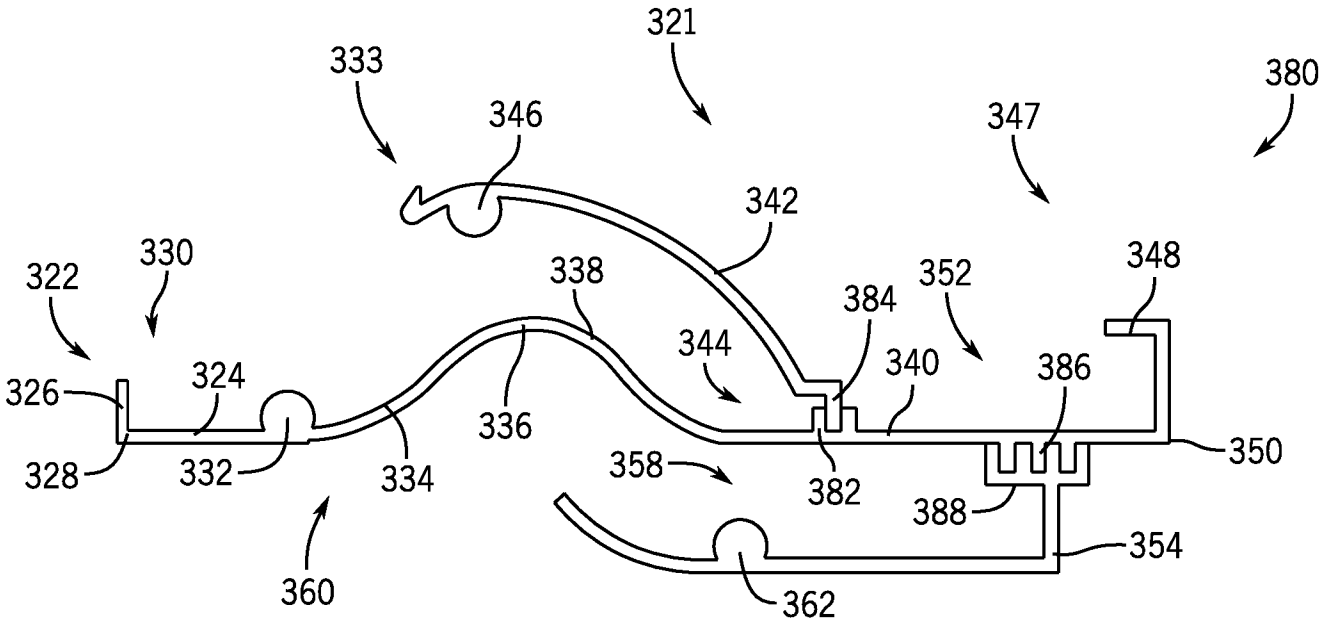
FIG. 10 is an axial view of an embodiment of a louver blade that may be incorporated in a louver assembly, in accordance with an aspect of the present disclosure.

FIG. 10 is an axial view of an embodiment of a louver blade 380 that may be incorporated in the louver assembly 50. The louver blade 380 may have a similar geometry as any of the louver blades described above, such as one of the louver blades 320 described with respect to FIG. 9. However, the illustrated louver blade 380 includes separate pieces that are coupled to one another. By way of example, the second segment 340 of the louver blade 380 may include first formations 382 (e.g., ridges, ribs, etc.). The first formations 382 may be configured to receive an end 384 of the second extension 342 to couple the second extension 342 and the second segment 340 to one another. For instance, the first formations 382 may compress against the end 384 via an interference fit, thereby securing the second extension 342 and the second segment 340 to one another. Furthermore, the second segment 340 may include second formations 386 (e.g., ridges, ribs, etc.) configured to receive third formations 388 (e.g., ridges, ribs, etc.) of the fourth extension 354, thereby coupling the second segment 340 and the fourth extension 354 to one another, such as via an interference fit. Additionally or alternatively, a fastener, an adhesive, or other bonding technique may be used to couple the second extension 342 and the second segment 340 to one another and/or to couple the second segment 340 and the fourth extension 354 to one another.

It should be noted that any of the features illustrated and/or described herein may be incorporated with one another. For example, the louver assembly 50 may have louver blades that include any combination of the described extensions, protrusions, features, and so forth, as well as a jamb frame shaped to receive particles from the louver blade. Indeed, the louver blade of the louver assembly 50 may have formations that are shaped and sized increase a retention capacity of recesses for directing toward the jamb frame while enabling desirable air flow rate through the louver assembly 50.

The present disclosure may provide one or more technical effects useful in the operation of an HVAC system. For example, the HVAC system may include a louver assembly configured to enable air flow between an interior and an exterior of an HVAC system or other enclosed space. The louver assembly may include louver blades having features configured to block solid and/or liquid particles from passing through the louver assembly, thereby blocking the solid and/or liquid particles from entering the HVAC system or enclosed space. In some embodiments, each louver blade may include various features, extensions, protrusions, and the like, that may block solid and/or liquid particles from flowing past the louver blade and through the louver assembly. Additionally, each louver blade may include one or more recesses configured to capture or retain the blocked solid and/or liquid particles and to direct the solid and/or liquid particles toward jamb frames configured to direct the solid and/or liquid particles out of the louver assembly. An opening may be formed between adjacent louver blades to form an air flow path permitting air to flow through the louver assembly. Indeed, the louver blades may permit air to flow through the louver assembly at a desirable flow rate, such as to enable efficient operation of an HVAC system. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A louver blade for a louver assembly, the louver blade comprising:

a first section;

a second section extending from the first section and comprising a crest of the louver blade;

an extension extending from the second section to form a recess between the extension and the second section, wherein the extension comprises a portion extending linearly over the crest, and wherein the extension is configured guide particles into the recess in an installed configuration of the louver blade with the louver assembly; and a protrusion extending from the second section toward the extension and configured to facilitate retention of the particles within the recess.

2. The louver blade of claim 1, comprising an additional extension extending from a distal end of the first section to form an additional recess of the first section.

3. The louver blade of claim 2, wherein the first section comprises an incline portion configured to guide particles toward the additional recess in the installed configuration of the louver blade with the louver assembly.

4. The louver blade of claim 1, comprising a third section extending from the second section, wherein the third section comprises an additional extension extending from the third section to form an additional recess of the third section.

5. The louver blade of claim 4, wherein the additional extension extends from a distal end of the third section, and the recess and the additional recess are formed on a common side of the louver blade.

6. The louver blade of claim 4, wherein the recess is formed on a first side of the louver blade, and the additional recess is formed on a second side of the louver blade, opposite the first side.

7. The louver blade of claim 6, wherein the additional extension overlaps with the extension along a vertical axis.

8. The louver blade of claim 4, wherein the extension is separately coupled to the second section, the additional extension is separately coupled to the third section, or both.

9. The louver blade of claim 1, wherein the louver blade is an integrally formed piece.

10. The louver blade of claim 1, wherein the extension extends beyond the crest toward the first section.

11. A louver assembly for a heating, ventilation, and air conditioning (HVAC) system, the louver assembly comprising:

a louver blade comprising a first portion, a second portion extending from the first portion and forming a crest with the first portion, a first extension extending from the second portion on a first side of the louver blade to form a first recess between the second portion and the first extension, and a second extension extending from the second portion on a second side of the louver blade, opposite the first side, to form a second recess between the second portion and the second extension, wherein the first extension and the second extension overlap with one another along an axis crosswise to a direction of air flow through the louver assembly such that the second portion is positioned between the first extension and the second extension along the axis; and a jamb frame coupled to the louver blade, wherein the jamb frame comprises a first channel and a second channel, the first channel is aligned with the first recess relative to the direction of air flow through the louver assembly, and the second channel is aligned with the second recess relative to the direction of air flow through the louver assembly.

12. The louver assembly of claim 11, comprising a sill frame coupled to the jamb frame, wherein the louver blade is engaged with the sill frame to form a cavity defined by the louver blade and the sill frame.

13. The louver assembly of claim 12, wherein the sill frame comprises a base, the first portion comprises an upstream distal end, and engagement between the louver blade and the sill frame forms an opening between the upstream distal end and the base.

14. The louver assembly of claim 11, comprising a head frame coupled to the jamb frame, wherein an underside of the head frame comprises a geometry corresponding to the second side of the louver blade.

15. The louver assembly of claim 11, wherein the louver blade comprises a third extension extending from an upstream distal end of the first portion and forming a third recess between the third extension and the first portion, and the jamb frame comprises a third channel aligned with the third recess relative to the direction of air flow through the louver assembly.

16. The louver assembly of claim 11, comprising a retention passage extending from the second extension toward the second recess, wherein the retention passage is configured to receive a fastener to couple the louver blade to the jamb frame.

17. A louver blade for a louver assembly, the louver blade comprising:

an upstream section comprising an incline portion;

a midstream section comprising a decline portion extending from the incline portion to form a crest of the louver blade with the incline portion on a first side of the louver blade;

a downstream section extending from the midstream section;

an extension of the midstream section, wherein the extension extends in an upstream direction to form a recess between the extension and the midstream section on the first side of the louver blade, wherein the extension comprises a portion extending linearly over the crest; and a protrusion of the midstream section, wherein the protrusion extends toward the recess and is configured to retain liquid particles captured within the recess.

18. The louver blade of claim 17, wherein the protrusion extends from the decline portion or the crest.

19. The louver blade of claim 17, wherein the protrusion extends from the extension.

20. The louver blade of claim 17, comprising an additional extension extending from the downstream section to form an additional recess between the additional extension and the downstream section on a second side of the louver blade, opposite the first side, and wherein the additional extension overlaps with the extension relative to an axis extending crosswise to a direction of air flow across the louver blade.

* * * * *